US006908343B1

(12) United States Patent
Hu

(10) Patent No.: US 6,908,343 B1
(45) Date of Patent: Jun. 21, 2005

(54) EARPHONE JACK

(75) Inventor: Chien-Ming Hu, Tainan Hsien (TW)

(73) Assignee: Excel Cell Electronic Co., Ltd., Taichung (TW)

( * ) Notice: Subject to any disclaimer, the term of this patent is extended or adjusted under 35 U.S.C. 154(b) by 0 days.

(21) Appl. No.: 10/855,759

(22) Filed: May 26, 2004

(51) Int. Cl.[7] ..... H01R 24/04
(52) U.S. Cl. ..... 439/668; 439/944
(58) Field of Search ..... 439/668, 669, 439/670, 744, 746, 188, 944

(56) References Cited

U.S. PATENT DOCUMENTS 4,867,708 A * 9/1989 Iizuka ..... 439/668
5,092,795 A * 3/1992 Kitagawa ..... 439/668
6,077,126 A * 6/2000 Peng ..... 439/668
6,595,804 B2 * 7/2003 Nagata ..... 439/668
6,676,451 B2 * 1/2004 Suzuki et al. ..... 439/668

* cited by examiner

*Primary Examiner*—Hien Vu
(74) *Attorney, Agent, or Firm*—Townsend and Townsend and Crew LLP

(57) ABSTRACT

An earphone jack includes an insulative housing and conductive first, second and third contact members. The insulative housing has opposite front and rear ends, and is formed with a plug insertion hole that extends from the front end to the rear end. The plug insertion hole has front and rear hole sections adjacent to the front and rear ends of the insulative housing, respectively. The insulative housing is formed with a first contact mounting portion adjacent to the front end of the insulative housing, and a second contact mounting portion between the first contact mounting portion and the rear end of the insulative housing. The conductive first and second contact member are mounted on the insulative housing at the first and second contact mounting portions, respectively, and extend into the front hole section. The third contact member has a pair of prongs that extend into the rear hole section.

6 Claims, 7 Drawing Sheets

EARPHONE JACK

BACKGROUND OF THE INVENTION

1. Field of the Invention

The invention relates to an earphone jack, more particularly to an earphone jack that has a reliable construction.

2. Description of the Related Art

FIGS. 1 to 3 illustrate a conventional earphone jack 1 for use with a mating plug 2 of an electronic apparatus. The earphone jack 1 includes an insulative housing 11, and conductive first, second, third and fourth contact members 12, 13, 14, 15 mounted on the insulative housing 11.

The insulative housing 11 has opposite front and rear ends 1121, 1122, and is formed with a plug insertion hole 112 that extends along a hole axis (A) from the front end 1121 to the rear end 1122. The plug insertion hole 112 has a front hole section 1130 adjacent to the front end 1121 of the insulative housing 11, and a rear hole section 1131 adjacent to the rear end 1122 of the insulative housing 11. The insulative housing 11 is further formed with a first contact mounting portion 114 adjacent to the front end 1121 of the insulative housing 11, and a second contact mounting portion 115 between the first contact mounting portion 114 and the rear end 1122 of the insulative housing 11.

The first contact member 12 is mounted on the insulative housing 11 at the first contact mounting portion 114, and includes a plug contacting portion 121 that extends into the front hole section 1130, and a contact tab 122 that extends horizontally away from the insulative housing 11.

The second contact member 13 is mounted on the insulative housing 11 at the second contact mounting portion 115, and includes a plug contacting portion 131 that extends into the front hole section 1130, and a contact tab 132 that extends horizontally away from the insulative housing 11.

The third contact member 14 is mounted in the insulative housing 11, and has a frame portion 141 disposed in the plug insertion hole 112, and a resilient portion 142 extending upwardly and obliquely from the frame portion 141. A contact tab 1411 extends from the frame portion 141 and outwardly of the insulative housing 11.

The fourth contact member 15 is mounted in the rear hole section 1131 of the plug insertion hole 112, and cooperates with the third contact member 14 to form a switch mechanism. Particularly, when the plug 2 is not inserted into the plug insertion hole 112, a tip of the resilient portion 142 contacts the fourth contact member 15 to result in a closed circuit condition, as best shown in FIG. 2. A contact tab 151 extends from the fourth contact member 15 and outwardly of the insulative housing 11.

Referring to FIG. 3, when the plug 2 is inserted into the plug insertion hole 112, the plug contacting portions 121, 131 of the first and second contact members 12, 13 and the resilient portion 142 of the third contact member 14 contact different parts of the plug 2 to effect signal transmission. At the same time, the resilient portion 142 of the third contact member 14 is moved away from the fourth contact member 15 to result in an open circuit condition.

The following are some of the drawbacks of the aforesaid conventional earphone jack 1:

1. In view of the cantilever design of the plug contacting portions 121, 131 of the first and second contact members 12, 13, the plug contacting portions 121, 131 are liable to deform after repeated insertion and removal of the plug 2, which can lead to poor electrical contact with the plug 2.

2. The resilient portion 142 is prone to break away from the frame portion 141 of the third contact member 14 due to stress concentration at the juncture of the frame and resilient portions 141, 142 after repeated insertion and removal of the plug 2.
3. The retention force attributed to the resilient portion 142 and acting on the plug 2 is relatively weak due to the small contact area therebetween.

SUMMARY OF THE INVENTION

Therefore, the object of the present invention is to provide an earphone jack with are liable construction that can overcome the aforesaid drawbacks associated with the prior art.

Accordingly, the earphone jack of the present invention comprises an insulative housing and conductive first, second and third contact members.

The insulative housing has opposite front and rear ends, and is formed with a plug insertion hole that extends from the front end to the rear end. The plug insertion hole has a front hole section adjacent to the front end of the insulative housing, and a rear hole section adjacent to the rear end of the insulative housing. The rear hole section is larger than the front hole section. The insulative housing further has a top wall that extends from the front end to the rear end of the insulative housing, and first and second lateral walls disposed on opposite lateral sides of the top wall. The insulative housing is formed with a first contact mounting portion adjacent to the front end of the insulative housing, and a second contact mounting portion between the first contact mounting portion and the rear end of the insulative housing. The first contact mounting portion is formed with a U-shaped first contact mounting groove that has a top groove portion formed in the top wall of the insulative housing, and first and second lateral groove portions extending from the top groove portion and formed respectively in the first and second lateral walls of the insulative housing. The top groove portion of the first contact mounting groove is in spatial communication with the front hole section of the plug insertion hole. The second contact mounting portion is formed with a U-shaped second contact mounting groove that has a top groove portion formed in the top wall of the insulative housing, and first and second lateral groove portions extending from the top groove portion of the second contact mounting groove and formed respectively in the second and first lateral walls of the insulative housing. The top groove portion of the second contact mounting groove is in spatial communication with the front hole section of the plug insertion hole.

The first contact member is mounted on the insulative housing at the first contact mounting portion. The first contact member includes: a first leg portion received in the first lateral groove portion of the first contact mounting groove and engaging the first lateral wall of the insulative housing; a plug contacting portion extending laterally from the first leg portion, received in the top groove portion of the first contact mounting groove, and extending into the front hole section of the plug insertion hole; and a second leg portion extending downwardly from the plug contacting portion, received in the second lateral groove portion of the first contact mounting groove, and engaging the second lateral wall of the insulative housing.

The second contact member is mounted on the insulative housing at the second contact mounting portion. The second contact member includes: a first leg portion received in the first lateral groove portion of the second contact mounting groove and engaging the second lateral wall of the insulative housing; a plug contacting portion extending laterally from the first leg portion of the second contact member, received in the top groove portion of the second contact mounting groove, and extending into the front hole section of the plug insertion hole; and a second leg portion extending downwardly from the plug contacting portion of the second contact member, received in the second lateral groove portion of the second contact mounting groove, and engaging the first lateral wall of the insulative housing.

The third contact member has a pair of prongs that extend into the rear hole section through the rear end of the insulative housing.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
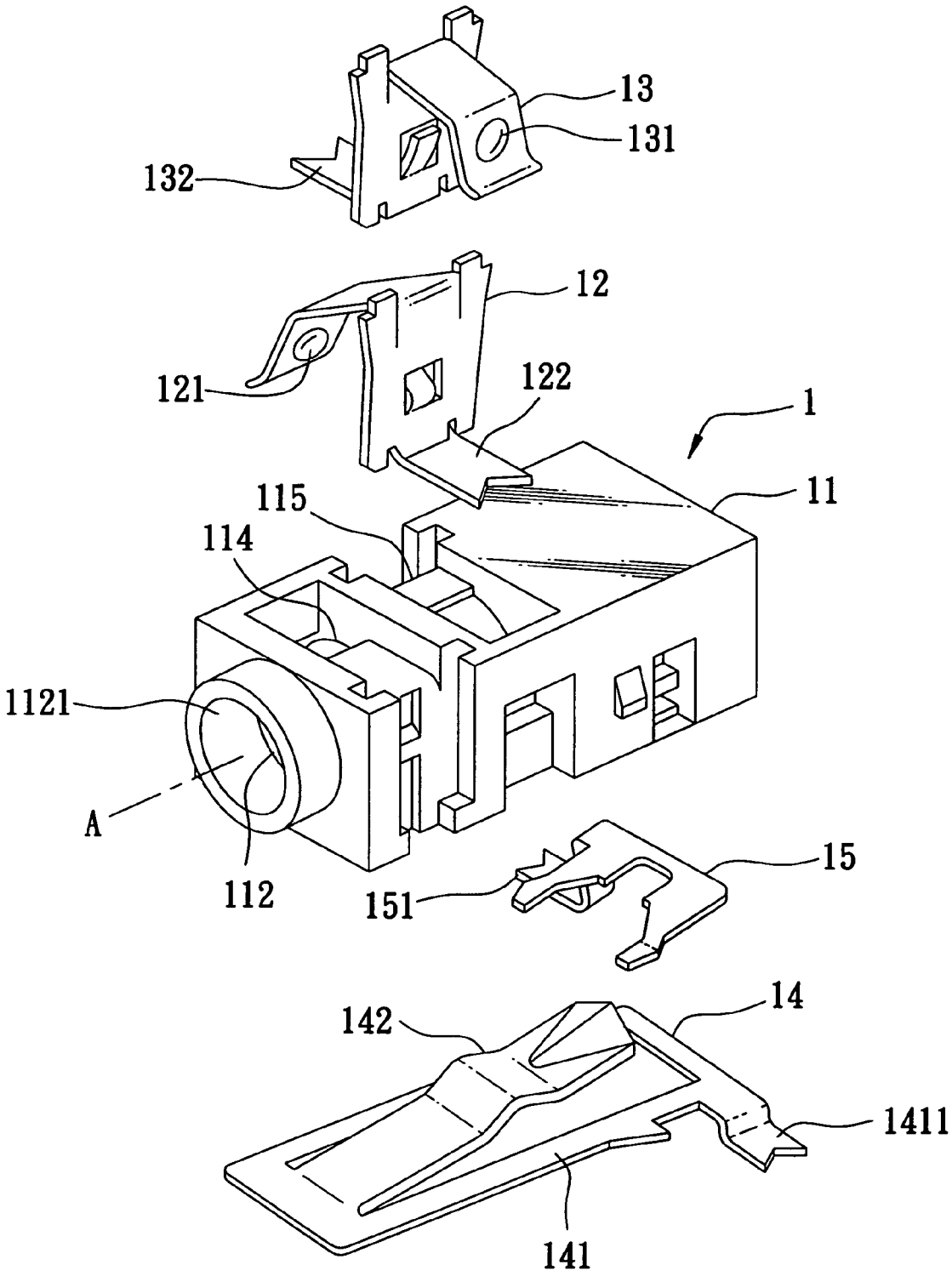
FIG. 1 PRIOR ART
FIG. 1 is an exploded perspective view of a conventional earphone jack.
Figure 2:
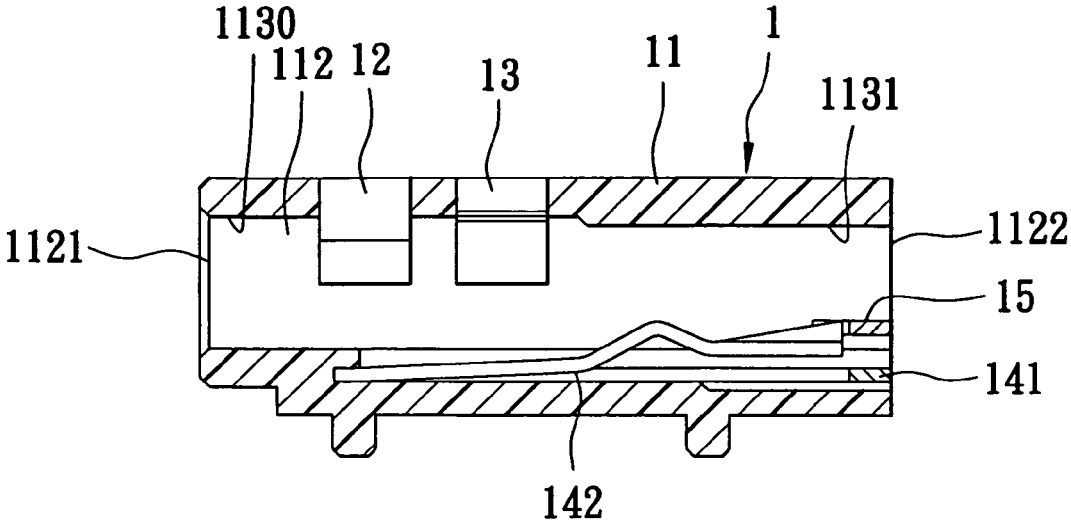
FIG. 2 PRIOR ART
FIG. 2 is a sectional view of the conventional earphone jack of FIG. 1.
Figure 3:
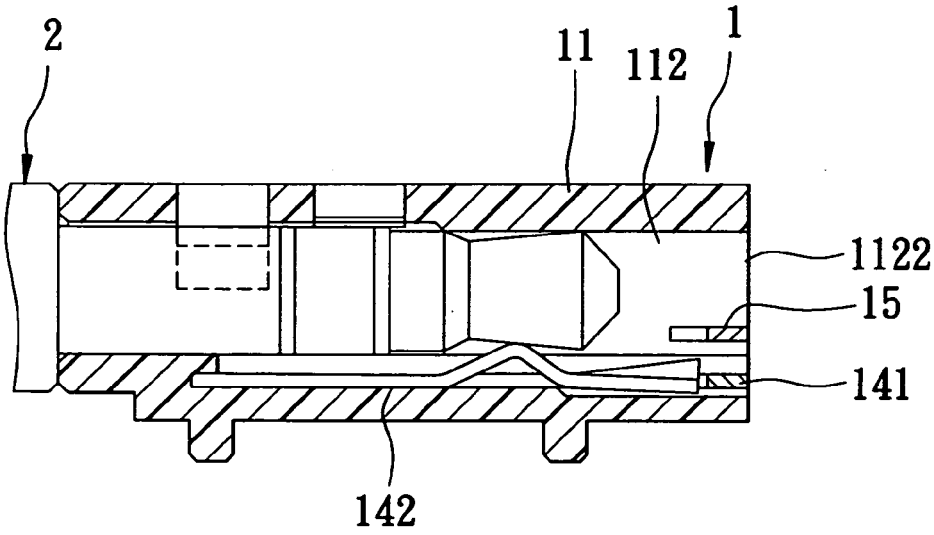
FIG. 3 PRIOR ART
FIG. 3 is another sectional view to illustrate the conventional earphone jack of FIG. 1 in a state of use.
Figure 4:
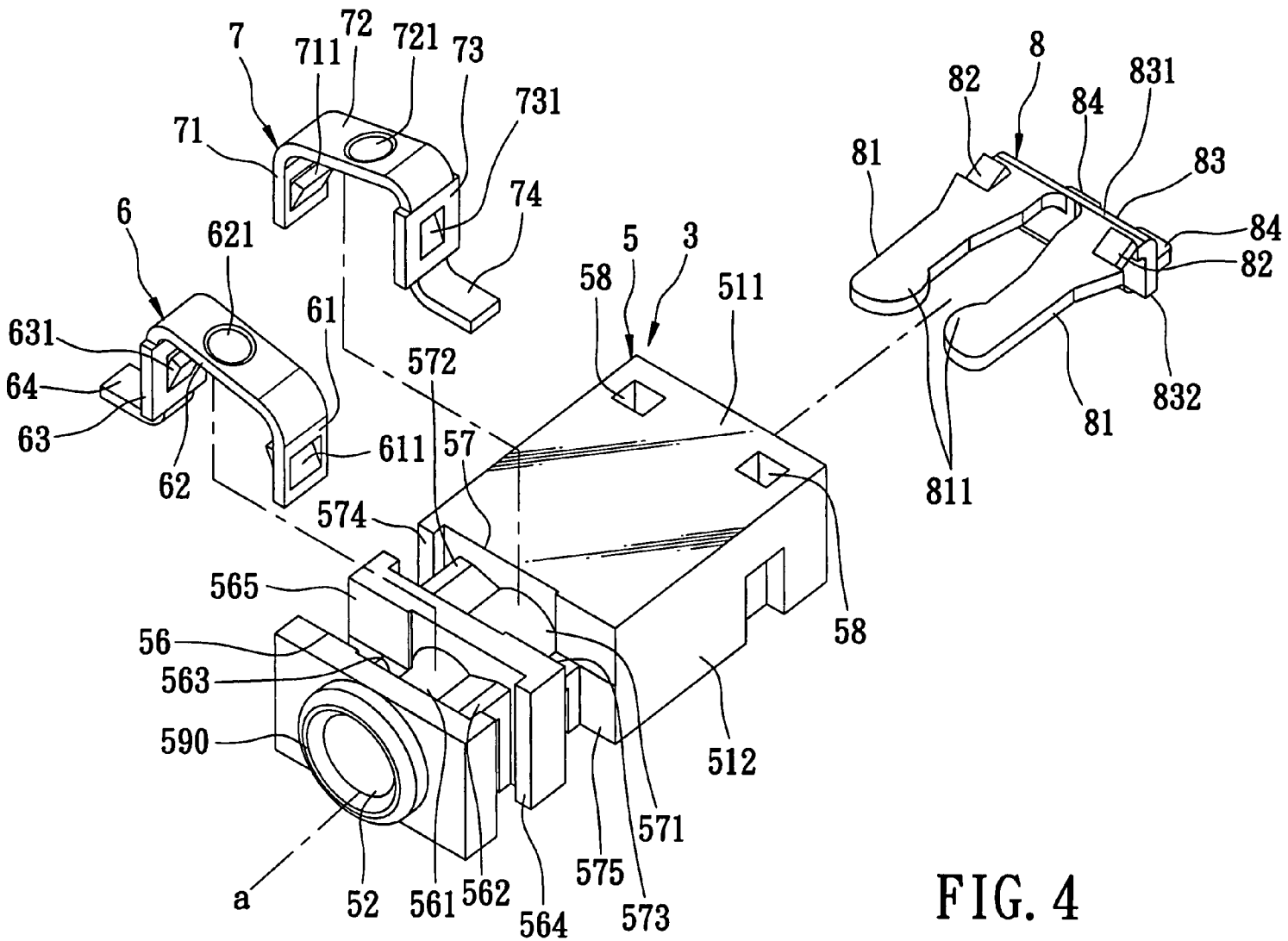
FIG. 4 is an exploded perspective view of the preferred embodiment of an earphone jack according to the present invention.
Figure 5:
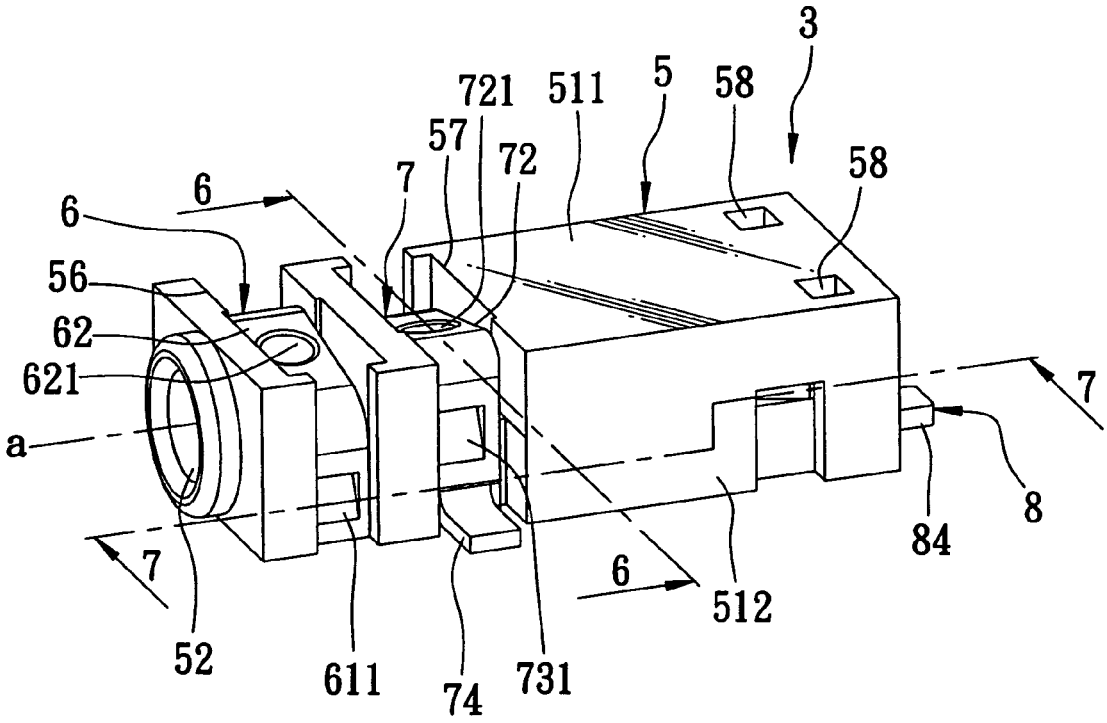
FIG. 5 is an assembled perspective view of the preferred embodiment.

Referring to FIGS. 4 to 8, the preferred embodiment of an earphone jack 3 according to the present invention is adapted for use with a mating plug 4 of an electronic apparatus. The earphone jack 3 includes an insulative housing 5, and conductive first, second, third contact members 6, 7, 8 mounted on the insulative housing 5.

The insulative housing 5 has opposite front and rear ends 590, 591, and is formed with a plug insertion hole 52 that extends along a hole axis (a) from the front end 590 to the rear end 591. The plug insertion hole 52 has a front hole section 53 adjacent to the front end 590 of the insulative housing 5, and a rear hole section 54 adjacent to the rear end 591 of the insulative housing 5. The rear hole section 54 is larger than the front hole section 53. The insulative housing 5 further has a top wall 511 that extends from the front end 590 to the rear end 591 of the insulative housing 5, and first and second lateral walls 512, 513 disposed on opposite lateral sides of the top wall 511. The top wall 511 is formed with a pair of engaging holes 58 proximate to the rear end 591 of the insulative housing 5. The insulative housing 5 is further formed with a first contact mounting portion 56 adjacent to the front end 590 of the insulative housing 5, and a second contact mounting portion 57 between the first contact mounting portion 56 and the rear end 591 of the insulative housing 5.

Figure 6:
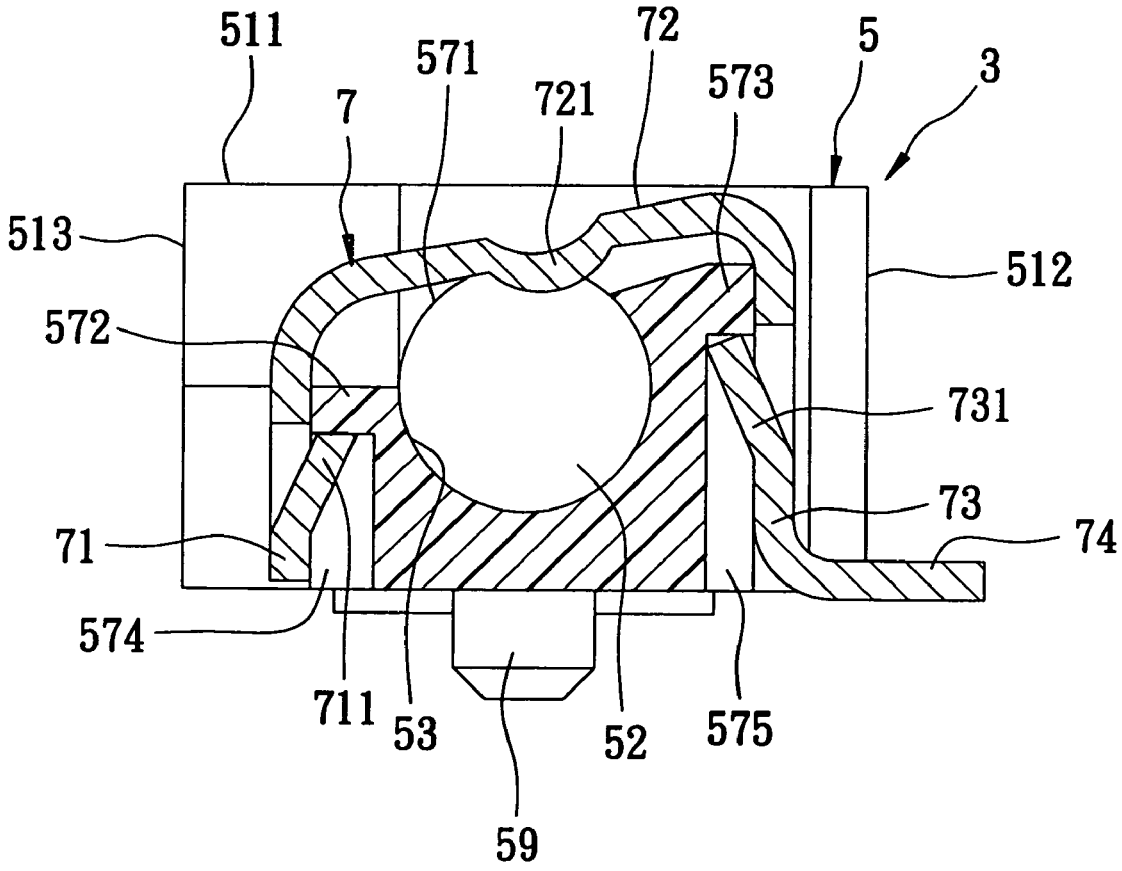
FIG. 6 is a sectional view of the preferred embodiment, taken along line 6—6 of FIG. 5.
Figure 7:
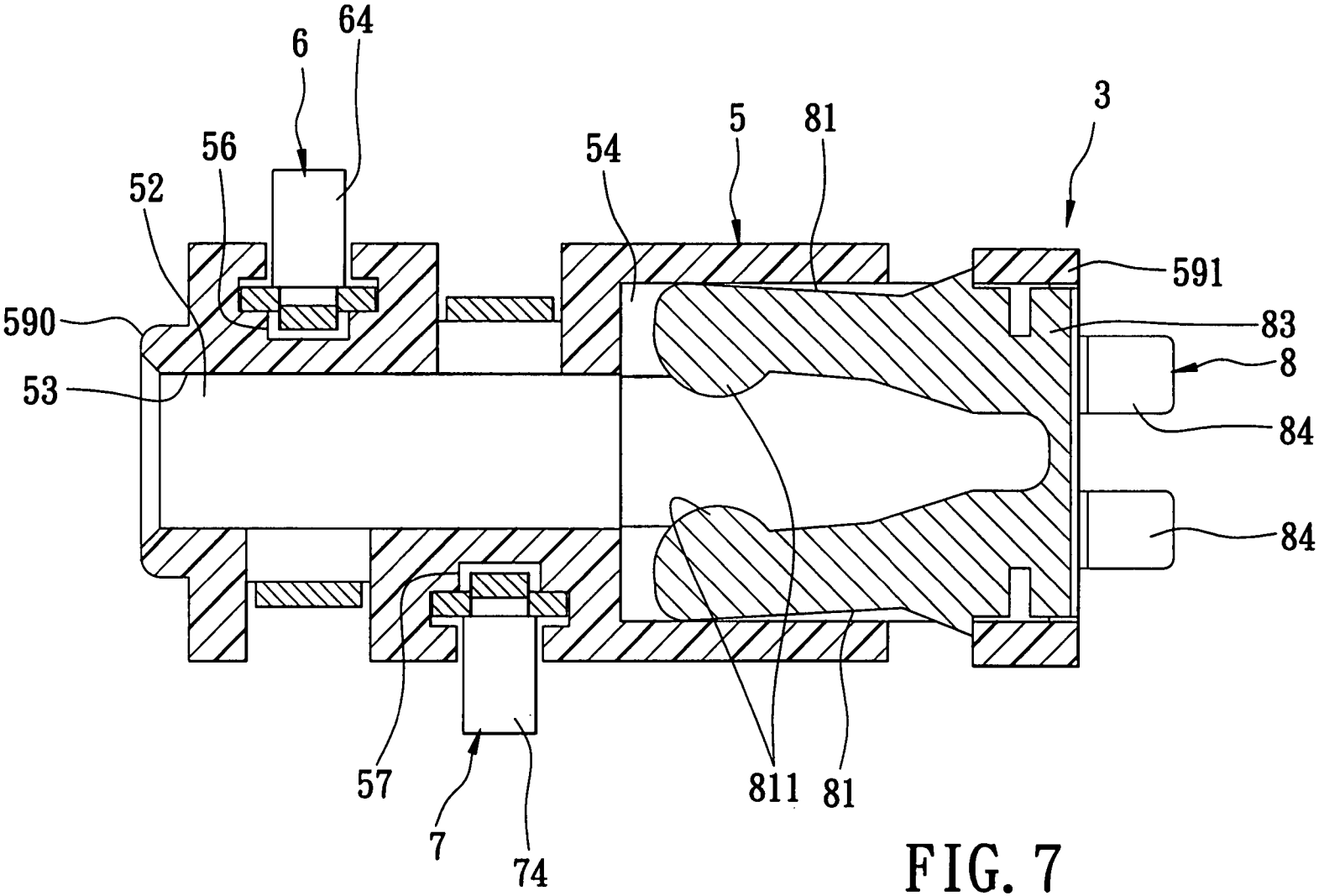
FIG. 7 is another sectional view of the preferred embodiment, taken along line 7—7 of FIG. 5.

The first contact mounting portion 56 is formed with a U-shaped first contact mounting groove that has a top groove portion 561 formed in the top wall 511, and first and second lateral groove portions 564, 565 extending from the top groove portion 561 and formed respectively in the first and second lateral walls 512, 513. The top groove portion 561 of the first contact mounting groove is in spatial communication with the front hole section 53 of the plug insertion hole 52. Like the first contact mounting portion 56, the second contact mounting portion 57 is also formed with a U-shaped second contact mounting groove that has a top groove portion 571 formed in the top wall 511, and first and second lateral groove portions 574, 575 extending from the top groove portion 571 and formed respectively in the second and first lateral walls 513, 512. The top groove portion 571 of the second contact mounting groove is in spatial communication with the front hole section 53 of the plug insertion hole 52, as best shown in FIG. 6.

The first contact member 6 is mounted on the insulative housing 5 at the first contact mounting portion 56, and includes a first leg portion 61, a plug contacting portion 62, and a second leg portion 63. The first leg portion 61 is received in the first lateral groove portion 564 of the first contact mounting groove, and engages the first lateral wall 512 of the insulative housing 5. The plug contacting portion 62 extends laterally from the first leg portion 61, is received in the top groove portion 561 of the first contact mounting groove, and extends into the front hole section 53 of the plug insertion hole 52. The second leg portion 63 extends downwardly from the plug contacting portion 62, is received in the second lateral groove portion 565 of the first contact mounting groove, and engages the second lateral wall 513 of the insulative housing 5. The first contact member 6 further includes a first contact tab 64 extending horizontally from the second leg portion 63 away from the insulative housing 5.

In this embodiment, the first leg portion 61 of the first contact member 6 is shorter than the second leg portion 63, and the plug contacting portion 62 of the first contact member 6 extends upwardly and obliquely from the first leg portion 61. Moreover, the first contact mounting portion 56 is further formed with a first stop flange 562 that extends from the first lateral wall 512 into the first lateral groove portion 564 of the first contact mounting groove, and a second stop flange 563 that extends from the second lateral wall 513 into the second lateral groove portion 565 of the first contact mounting groove. The first leg portion 61 of the first contact member 6 is formed with a first locking tab 611, such as by punching, for engaging a bottom side of the first stop flange 562. The second leg portion 63 of the first contact member 6 is formed with a second locking tab 631, such as by punching, for engaging a bottom side of the second stop flange 563.

The second contact member 7 is mounted on the insulative housing 5 at the second contact mounting portion 57, and includes a first leg portion 71, a plug contacting portion 72, and a second leg portion 73. The first leg portion 71 is received in the first lateral groove portion 574 of the second contact mounting groove, and engages the second lateral wall 513 of the insulative housing 5. The plug contacting portion 72 extends laterally from the first leg portion 71, is received in the top groove portion 571 of the second contact mounting groove, and extends into the front hole section 53 of the plug insertion hole 52. The second leg portion 73 extends downwardly from the plug contacting portion 72, is received in the second lateral groove portion 575 of the second contact mounting groove, and engages the first lateral wall 512 of the insulative housing 5. The second contact member 7 further includes a second contact tab 74 extending horizontally from the second leg portion 73 away from the insulative housing 5.

As best shown in FIG. 6, like the first contact member 6, the first leg portion 71 of the second contact member 7 is shorter than the second leg portion 73, and the plug contacting portion 72 of the second contact member 7 extends upwardly and obliquely from the first leg portion 71. Moreover, the second contact mounting portion 57 is likewise formed with a first stop flange 572 that extends from the second lateral wall 513 into the first lateral groove portion 574 of the second contact mounting groove, and a second stop flange 573 that extends from the first lateral wall 512 into the second lateral groove portion 575 of the second contact mounting groove. The first leg portion 71 of the second contact member 7 is formed with a first locking tab 711, such as by punching, for engaging a bottom side of the first stop flange 572. The second leg portion 73 of the second contact member 7 is formed with a second locking tab 731, such as by punching, for engaging a bottom side of the second stop flange 573.

Preferably, the plug contacting portions 62, 72 of the first and second contact members 6, 7 are formed with a respective contact boss 621, 721 to enhance contact engagement with the plug 4.

The third contact member 8 is a unitary body formed by punching, and has a base portion 83 with upper and lower edges 831, 832, and a pair of prongs 81 that extend from the upper edge 831 of the base portion 83. The prongs 81 extend into the rear hole section 54 through the rear end 591 of the insulative housing 5, are substantially flat, form a plug insertion space therebetween, and have distal end parts 811 remote from the base portion 83 and contoured to form a restricted access into the plug insertion space. Each of the prongs 81 is formed with an engaging tab 82, such as by punching, that extends into a respective one of the engaging holes 58 in the top wall 511 of the insulative housing 5, thereby retaining the third contact member 8 in the insulative housing 5. The third contact member 8 further has a set of third contact tabs 84 extending horizontally from the lower edge 832 of the base portion 83 away from the rear end 591 of the insulative housing 5.

As shown in FIG. 6, the insulative housing 5 further has a bottom wall formed with a positioning post 59 to facilitate anchoring of the insulative housing 5 during manufacturing. Since the feature of the invention does not reside in the positioning post 59, further details thereof will be omitted herein for the sake of brevity.

Figure 8:
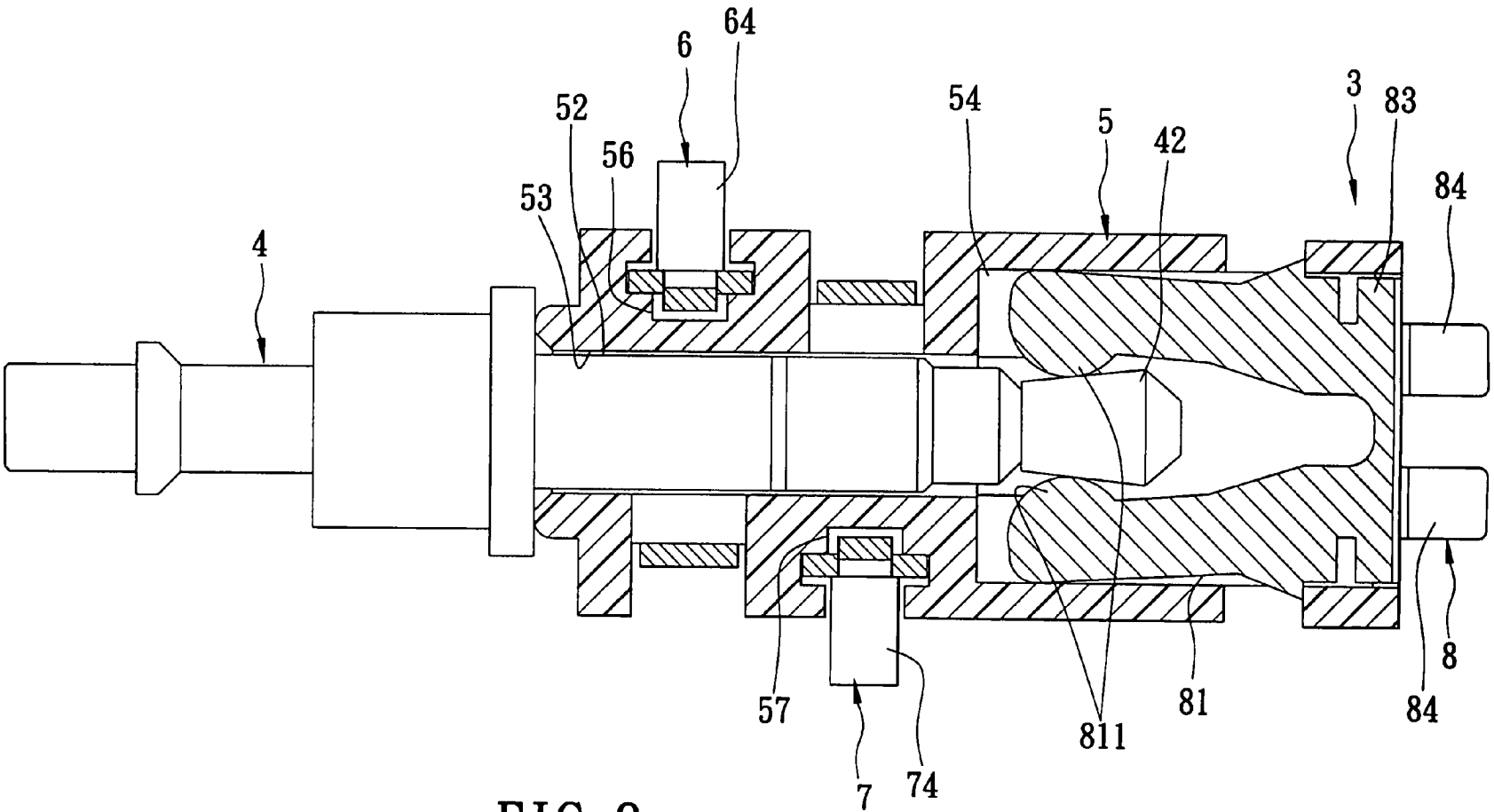
FIG. 8 is a view similar to FIG. 7, but illustrating the preferred embodiment in a state of use.

Referring to FIG. 8, when the plug 4 is inserted into the plug insertion hole 52, the first, second and third contact members 6, 7, 8 contact different parts of the plug 4 to effect signal transmission. Particularly, due to the configurations of the first and second contact members 6, 7, the plug contacting portions 62, 72 contacts parts of the plug 4 that are angularly and axially spaced apart relative to the hole axis (a). Moreover, the tip 42 of the plug 4 is gripped firmly by the prongs 81 of the third contact member 8 to result in a secure and reliable connection therebetween. Furthermore, since each of the first and second contact members 6, 7 has first and second leg portions 61, 63, 71, 73 that engage the lateral walls 512, 513 of the insulative housing 5, stable electrical connection between each of the first and second contact members 6, 7 and the plug 4 can be ensured even after repeated insertion and removal of the plug 4.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. An earphone jack comprising:

an insulative housing having opposite front and rear ends and formed with a plug insertion hole that extends from said front end to said rear end, said plug insertion hole having a front hole section adjacent to said front end of said insulative housing, and a rear hole section adjacent to said rear end of said insulative housing, said rear hole section being larger than said front hole section, said insulative housing having a top wall that extends from said front end to said rear end of said insulative housing, and first and second lateral walls disposed on opposite lateral sides of said top wall, said insulative housing being formed with a first contact mounting portion adjacent to said front end of said insulative housing, and a second contact mounting portion between said first contact mounting portion and said rear end of said insulative housing, said first contact mounting portion being formed with a U-shaped first contact mounting groove that has a top groove portion formed in said top wall of said insulative housing, and first and second lateral groove portions extending from said top groove portion and formed respectively in said first and second lateral walls of said insulative housing, said top groove portion of said first contact mounting groove being in spatial communication with said front hole section of said plug insertion hole, said second contact mounting portion being formed with a U-shaped second contact mounting groove that has a top groove portion formed in said top wall of said insulative housing, and first and second lateral groove portions extending from said top groove portion of said second contact mounting groove and formed respectively in said second and first lateral walls of said insulative housing, said top groove portion of said second contact mounting groove being in spatial communication with said front hole section of said plug insertion hole;

a conductive first contact member mounted on said insulative housing at said first contact mounting portion, said first contact member including a first leg portion received in said first lateral groove portion of said first contact mounting groove and engaging said first lateral wall of said insulative housing, a plug contacting portion extending laterally from said first leg portion, received in said top groove portion of said first contact mounting groove, and extending into said front hole section of said plug insertion hole, and a second leg portion extending downwardly from said plug contacting portion, received in said second lateral groove portion of said first contact mounting groove, and engaging said second lateral wall of said insulative housing;

a conductive second contact member mounted on said insulative housing at said second contact mounting portion, said second contact member including a first leg portion received in said first lateral groove portion of said second contact mounting groove and engaging said second lateral wall of said insulative housing, a plug contacting portion extending laterally from said first leg portion of said second contact member, received in said top groove portion of said second contact mounting groove, and extending into said front hole section of said plug insertion hole, and a second leg portion extending downwardly from said plug contacting portion of said second contact member, received in said second lateral groove portion of said second contact mounting groove, and engaging said first lateral wall of said insulative housing; and a conductive third contact member having a pair of prongs that extend into said rear hole section through said rear end of said insulative housing;

wherein said top wall of said insulative housing is formed with a pair of engaging holes proximate to said rear end of said insulative housing, each of said prongs of said third contact member being substantially flat and being formed with an engaging tab that engages a respective one of said engaging holes; and wherein said flat prongs are in a same plane and form a plug insertion space therebetween for receiving an end portion of a mating plug and have distal end parts contoured inwardly to form restricted access into said plug insertion space.

2. The earphone jack as claimed in claim 1, wherein said first leg portions of said first and second contact members are shorter than said second leg portions, said plug contacting portion of each of said first and second contact members extending upwardly and obliquely from said first leg portion.

3. The earphone jack as claimed in claim 1, wherein:

said first contact mounting portion is formed with a first stop flange that extends from said first lateral wall into said first lateral groove portion of said first contact mounting groove, and a second stop flange that extends from said second lateral wall into said second lateral groove portion of said first contact mounting groove;

said first leg portion of said first contact member being formed with a first locking tab to engage said first stop flange;

said second leg portion of said first contact member being formed with a second locking tab to engage said second stop flange.

4. The earphone jack as claimed in claim 3, wherein said first contact member further includes a first contact tab extending horizontally from said second leg portion away from said insulative housing.

5. The earphone jack as claimed in claim 1, wherein:

said second contact mounting portion is formed with a first stop flange that extends from said second lateral wall into said first lateral groove portion of said second contact mounting groove, and a second stop flange that extends from said first lateral wall into said second lateral groove portion of said second contact mounting groove;

said first leg portion of said second contact member being formed with a first locking tab to engage said first stop flange;

said second leg portion of said second contact member being formed with a second locking tab to engage said second stop flange.

6. The earphone jack as claimed in claim 5, wherein said second contact member further includes a second contact tab extending horizontally from said second leg portion away from said insulative housing.

* * * * *